US006709292B1

(12) United States Patent
Barefoot

(10) Patent No.: US 6,709,292 B1
(45) **Date of Patent: *Mar. 23, 2004**

(54) COMMUNICATION EQUIPMENT SHELF SYSTEM AND SHIELDED CABLE ASSEMBLY FOR USE IN SAME

(75) Inventor: Trace Barefoot, Raleigh, NC (US)

(73) Assignee: Alcatel, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/989,344

(22) Filed: Nov. 20, 2001

Related U.S. Application Data

(63) Continuation-in-part of application No. 09/812,080, filed on Mar. 19, 2001, now Pat. No. 6,409,542.

(51) Int. Cl.[7] ..... H01R 13/648
(52) U.S. Cl. ..... 439/607
(58) Field of Search ..... 439/607, 608, 439/609, 610, 738, 676, 541.5, 901, 447, 404

(56) References Cited

U.S. PATENT DOCUMENTS 6,409,542 B1 * 6/2002 Ivey, Jr. et al. ..... 439/608

* cited by examiner

*Primary Examiner*—Jean F. Duverne
(74) *Attorney, Agent, or Firm*—Simon, Galasso & Frantz; Craig A. Hoersten; V. Lawrence Sewell

(57) ABSTRACT

One embodiment of a communication equipment shelf system includes a communication shelf, a backplane assembly, a plurality of communication cards and a plurality of backplane connector assemblies. The communication equipment shelf has a prescribed shelf depth. The prescribed shelf depth is defined between a first face and a second face of the communication equipment shelf. The backplane assembly is mounted on the communication equipment shelf at a position between the first face and the second face of the communication equipment shelf. The backplane assembly includes a backplane circuit substrate. A plurality of card edge connectors is mounted on a first side of the backplane circuit substrate and a plurality of backplane connectors is mounted on a second side of the backplane circuit substrate. A first row of the backplane connectors is offset from a second row of the backplane connectors. A pair of the backplane connectors of the first row and an associated one of the backplane connectors of the second row are electrically connected to each of a pair of the card edge connectors for carrying communication signals therebetween. The plurality of communication cards is mounted on the communication equipment shelf. Each one of the communication cards has a card edge portion thereof engaged with a corresponding one of the card edge connectors. Each one of the communication cards is positioned between the first face of the communication equipment shelf and the first side of the backplane circuit substrate. Each one of the backplane connectors has a 180 degree backplane connector assembly of a corresponding one of the backplane cable assemblies attached thereto. Each one of the backplane cable assemblies is capable of being confined between the second face of the communication equipment shelf and the second side of the backplane circuit substrate.

12 Claims, 8 Drawing Sheets

COMMUNICATION EQUIPMENT SHELF SYSTEM AND SHIELDED CABLE ASSEMBLY FOR USE IN SAME

CROSS REFERENCE TO RELATED APPLICATIONS

This application is a continuation-in-part of and claims the benefit to U.S. Utility patent application Ser. No. 09/812,080 filed Mar. 19, 2001 now U.S. Pat. No. 6,409,542 entitled "ELECTRICALLY SHIELDED CONNECTOR WITH OVERMOLDED INSULATING COVER," of common assignee herewith.

FIELD OF THE DISCLOSURE

The disclosures herein relate generally to communication equipment shelf systems and more particularly to a high-density splitter shelf system.

BACKGROUND

High-speed electronic equipment, such as high-speed computer equipment and telecommunications equipment, often require the use of cable assemblies including shielded cables, shielded connector assemblies or both. The space requirements for such equipment may sometimes result in the need to limit the physical size of associated cable assemblies. In such situations, a cable shielded assembly having a compact shielded connector assembly is often required as the bend radius of a cable portion of the cable assembly is fixed for a given size/type of cable.

A DSL splitter shelf (hereinafter the splitter shelf) having a backplane assembly mounted thereon is one example of such equipment in which space requirements may result in the need to limit the physical size of a cable assembly. The splitter shelf generally has a standardized maximum depth (hereinafter the shelf depth) associated therewith. One or more DSL splitter cards are mounted physically on the splitter shelf and are electrically connected to a corresponding card edge connector of the backplane assembly. The shelf depth must account for a combined depth of an DSL splitter card (hereinafter the splitter card) mounted on the splitter shelf and for one or more backplane cable assemblies connected to a corresponding backplane connector of the backplane assembly. Exceeding the shelf depth is generally unacceptable.

Each one of the splitter cards mounted on the splitter shelf carries a plurality of communication lines. For a given shelf configuration (i.e. shelf width and shelf height), the total number of communications lines capable of being carried in the splitter shelf largely dictates the density of the backplane connectors. Accordingly, as the number of communication lines on each splitter card increases and/or the number of cards mounted on the splitter shelf increases, so does the required number of backplane connectors.

Conventional communication equipment shelf systems exhibit a number of limitations particularly as the density of communication lines within a shelf system increases. A first limitation is the difficulty in physically accommodating a required number of backplane connectors for a given planar size of a backplane circuit substrate of the backplane assembly. A second limitation is the difficulty in safely routing a backplane cable assembly to each one of the backplane connectors without exceeding the shelf depth requirement and without having a connector of one backplane cable assembly interfere with that of another. A third limitation is the elevated cost and increased space requirements resulting from providing a dedicated set of backplane connectors for each one of a plurality of communication cards (e.g. splitter cards) within a splitter shelf.

Therefore, a communication equipment shelf system capable of overcoming at least a portion of the limitations discussed above is useful.

SUMMARY

One embodiment of a communication equipment shelf system includes a communication shelf, a backplane assembly, a plurality of communication cards and a plurality of backplane connector assemblies. The communication equipment shelf has a prescribed shelf depth. The prescribed shelf depth is defined between a first face and a second face of the communication equipment shelf. The backplane assembly is mounted on the communication equipment shelf at a position between the first face and the second face of the communication equipment shelf. The backplane assembly includes a backplane circuit substrate. A plurality of card edge connectors is mounted on a first side of the backplane circuit substrate and a plurality of backplane connectors is mounted on a second side of the backplane circuit substrate. A first row of the backplane connectors is offset from a second row of the backplane connectors. A pair of the backplane connectors of the first row and an associated one of the backplane connectors of the second row are electrically connected to each of a pair of the card edge connectors for carrying communication signals therebetween. The plurality of communication cards is mounted on the communication equipment shelf. Each one of the communication cards has a card edge portion thereof engaged with a corresponding one of the card edge connectors. Each one of the communication cards is positioned between the first face of the communication equipment shelf and the first side of the backplane circuit substrate. Each one of the backplane connectors has a 180 degree backplane connector assembly of a corresponding one of the backplane cable assemblies attached thereto. Each one of the backplane cable assemblies is capable of being confined between the second face of the communication equipment shelf and the second side of the backplane circuit substrate.

DETAILED DESCRIPTION

Figure 1:
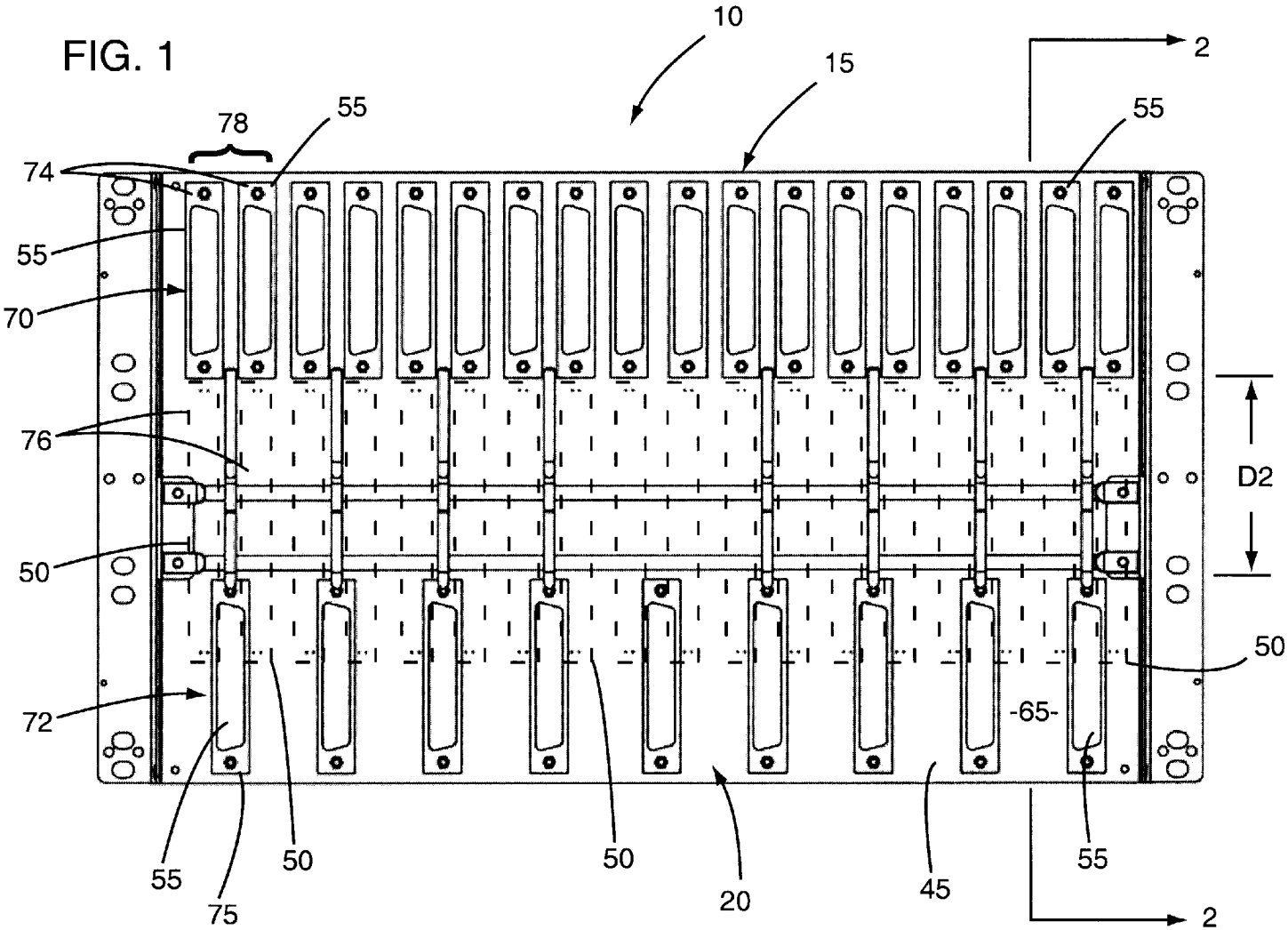
FIG. 1 is a rear view depicting a communication equipment shelf system (shielded cable cables assemblies omitted) in accordance with an embodiment of the disclosures herein.
Figure 2:
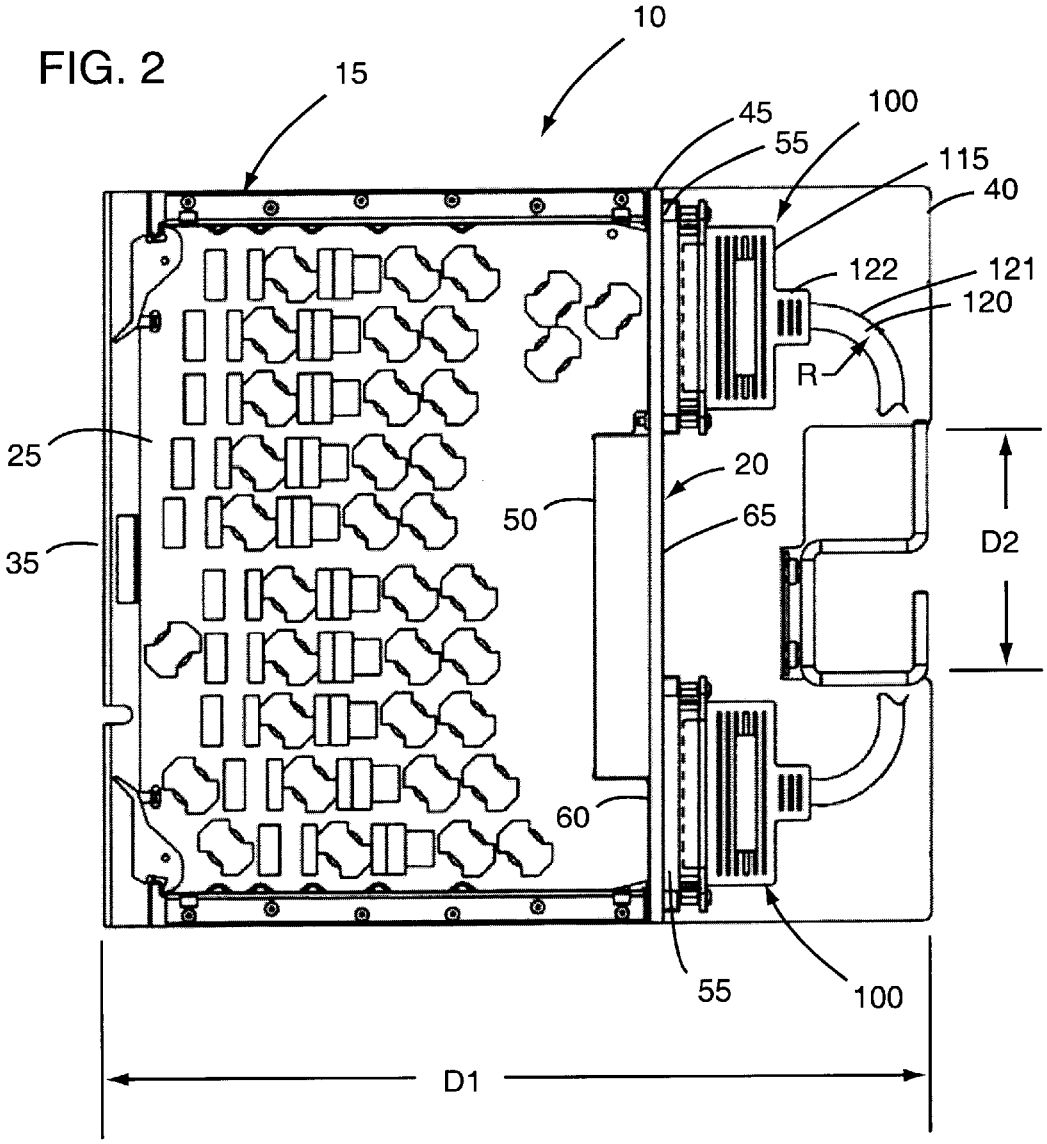
FIG. 2 is a cross sectional view taken along the line 2—2 in FIG. 1.
Figure 3:
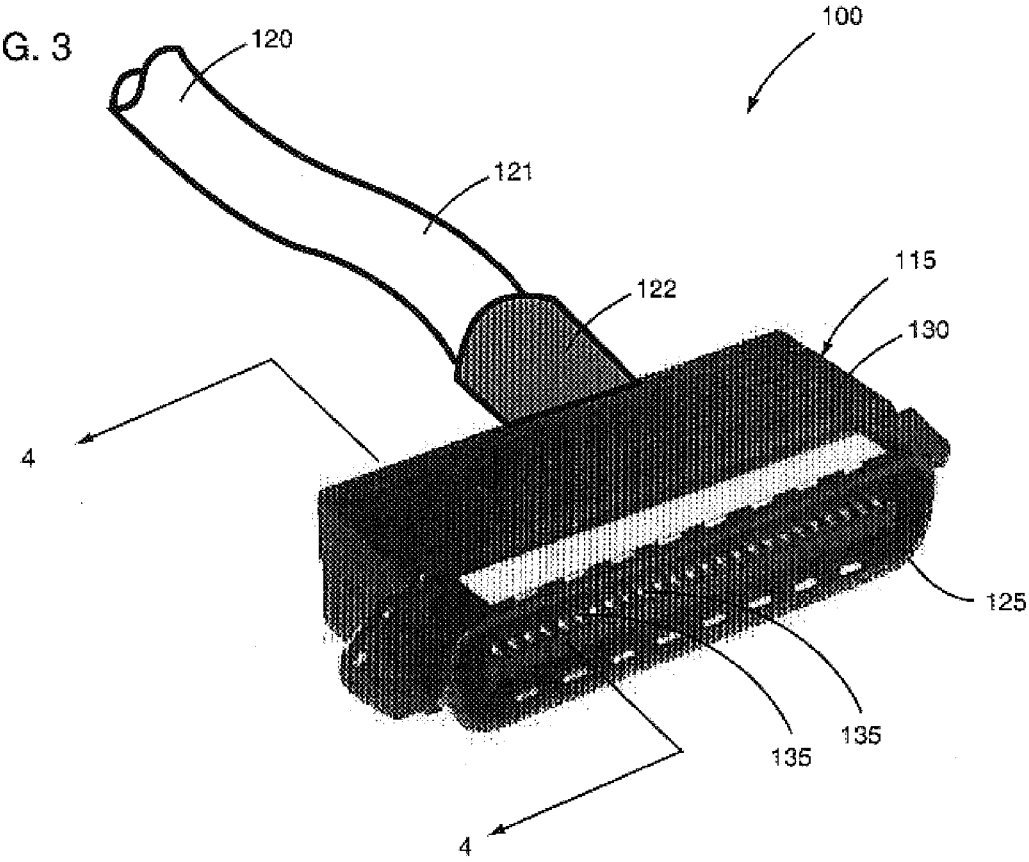
FIG. 3 is a partial perspective view depicting a shielded cable assembly in accordance with an embodiment of the disclosures herein.

FIGS. 1 and 2 depict a communication equipment shelf system 10 according to an embodiment of the disclosures herein. The shelf system 10 includes a shelf 15, a backplane assembly 20 and a plurality of communication cards 25 (one shown in the view of FIG. 2). Each one of the communication cards 25 are physically mounted on the shelf 15 and electrically connected to the backplane assembly 20. At least one industry standard requires a maximum shelf depth D1 of 12 inches for communication shelves.

The communication cards 25 are mounted in a stacked side-by side relationship. Various embodiments of the shelf 15 and the communication cards 25 are commercially available. Commercially available DSL splitter cards are an example of the communication cards 25.

The backplane assembly 20 is mounted on the shelf 15 between a first face 35 (e.g. a front face) and a second face 40 (e.g. a rear face) of the shelf 15. The backplane assembly 20 includes a circuit substrate 45 (e.g. a rigid printed circuit board), a plurality of card edge connectors 50 and a plurality of backplane connectors 55. The card edge connectors 50 are mounted on a first side 60 of the circuit substrate 45 and the backplane connectors 55 are mounted on a second side 65 of the circuit substrate 45.

A first row 70 of the backplane connectors 55 is offset from a second row 72 of the backplane connectors 55 by a reference distance D2. In one example, the reference distance D2 is less than about twice a minimum bend distance of a 90-degree backplane cable assembly. In such an example, the use of 90-degree backplane cable assemblies would result in interference of a first cable assembly with a second cable assembly for a given reference distance D2. Such interference of two or more 90-degree cable assemblies precludes connecting a cable assembly to each one of the backplane connectors 55 and/or necessitates the use of 180-degree cable assemblies causing the maximum shelf depth D1 to be exceeded. The minimum bend distance is defined herein to include the minimum bend radius of a cable and any additional distance provided by a cable strain relief portion of a cable connector. Exceeding the minimum bend radius of a given cable may result in one or more damaged cable conductors.

As depicted in FIG. 1, a pair 74 of the backplane connectors 55 of the first row 70 and an associated one 75 of the backplane connectors 55 of the second row 72 are electrically connected via the backplane circuit substrate 45 to each of a pair 76 of the card edge connectors 50 for carrying communication signals therebetween. The pair 74 of the backplane connectors 55 of the first row 70 and the associated one 75 of the backplane connectors 55 of the second row 72 define a linked set 78 of the backplane connectors 55. The linked set 78 of backplane connectors 55 and the pair 76 of card edge connectors 50 define a communication card interconnect cell.

A first one of the pair 74 of the backplane connectors 55 is positioned approximately in-line with a first one of the pair 76 of the card edge connectors 50. A second one of the pair 74 of backplane connectors 55 is positioned approximately in-line with a second one of the pair 76 of the card edge connectors 50. The associated one 75 of the backplane connectors of the second row 72 is positioned at least partially between the pair 76 of the card edge connectors 50.

The physical arrangement and electrical connection of the linked set 78 of the backplane connectors 55 provide a means of compactly mounting and electrically connecting an associated pair (not shown) of the communication cards 25 within the shelf 15. Preferably, the associated pair of communication cards is adjacent to each other. For example, the depicted one of the communication cards 25 in FIG. 2 and an adjacent other one of the communication cards 25 are an example of the associated pair of the communication cards 25.

Each one of the associated pair of communication cards 25 is electrically connected to a respective one of the pair 76 (i.e. set) of the card edge connectors 50. Because the associated pair of the communication cards 25 shares the linked set 78 of the backplane connectors 55, space on the backplane circuit substrate 20 is conserved. Specifically, the backplane connectors 55 include a sufficient number of contacts for routing signals to and from the associated adjacent pair of communication cards 25.

For example, in the case where the associated pair of the communication cards 25 is a pair of DSL splitter cards each having twelve communication lines, 50-contact connectors provide a sufficient number of contacts for routing signals to and from two such DSL splitter cards. Each one of the communication lines requires a first pair of contacts for enabling communication of composite communication signals, a second pair of contacts for enabling communication of telephonic-type communication signals and a third pair of contacts for enabling communication of DSL communication signals. Accordingly, the pair of DSL splitter cards requires forty-eight contacts for each type of communication signal (i.e. composite, telephonic-type and DSL). Thus, for a 50-contact connector, each backplane connector 55 of the linked 78 has two available contacts available for carrying a reference voltage and/or ground.

Still referring to the above example, each connector of the linked set 78 of the backplane connectors 55 may carry a different type of communication signal. A first one of the linked set 78 of backplane connectors 55 may carry composite communication signals (i.e. including telephonic-type communication signals and DSL communication signals). In at least one embodiment of the backplane assembly 20, a first contact set and a second contact set of the first one of the linked set 78 of the backplane connectors 55 are capable of communicating composite communication signals associated with a first one and a second one, respectively, of the pair 76 of the card edge connectors 20. A second one of the linked set 78 of backplane connectors 55 may carry exclusively telephonic-type communication signals. In at least one embodiment of the backplane assembly 20, a first contact set and a second contact set of the second one of the linked set 78 of the backplane connectors 55 are capable of communicating telephonic-type communication signals associated with the first one and the second one, respectively, of the pair 76 of the card edge connectors 20. A third one of the linked set 78 of backplane connectors 55 may carry exclusively DSL communication signals. In at least one embodiment of the backplane assembly 20, a first contact set and a second contact set of the third one of the linked set 78 of the backplane connectors 55 are capable of communicating DSL communication signals associated with the first one and the second one, respectively, of the pair 76 of the card edge connectors 20.

The associated pair of communication cards 25 discussed above is an example of an associated set of communication cards 25. The associated set of communication cards may include more than two communication cards 25 and each one of the communication card cells may include a corresponding number of card edge connectors 50. Furthermore, it is contemplated herein that the backplane assembly 20 includes a plurality of communication card interconnect cells, thus allowing a plurality of associated pairs of communication cards to be electrically connected to the backplane assembly 20.

As depicted in FIG. 2, the communication equipment shelf system 10 further includes a plurality of shielded cable assemblies 100. Each shielded cable assembly 100 includes a shielded connector assembly 115 and a shielded cable 120 electrically and physically attached at a first end 121 thereof to the shielded connector assembly 115. The shielded cable assembly 100 may have another connector assembly, such as another shielded connector assembly 115, electrically connected at a second end thereof. The shielded cable 120 exhibits a minimum bend radius R and the shielded connector assembly 115 includes a strain relief portion 122.

The shielded connector assembly 115 as disclosed herein has a compact construction relative to conventional connectors having a similar number of contacts. Such a compact construction aids in enabling the communication cards 25 and the shielded cable assemblies 115 to be confined between the first face 35 and second face 40 of the shelf 15. Accordingly, the communication shelf system 10 as disclosed herein is advantageous in applications having a high density of communication lines for given configurations of the shelf 15 and backplane assembly 45.

Referring to FIGS. 2 through 8, the shielded connector assembly 115 includes a connector body 125 having an insulating cover 130 formed thereon. An over-molding operation is one example of a suitable technique for forming the insulating cover 130 on the connector body 125. The connector body 125 includes a plurality of contacts members 135 attached thereto.

Figure 4:
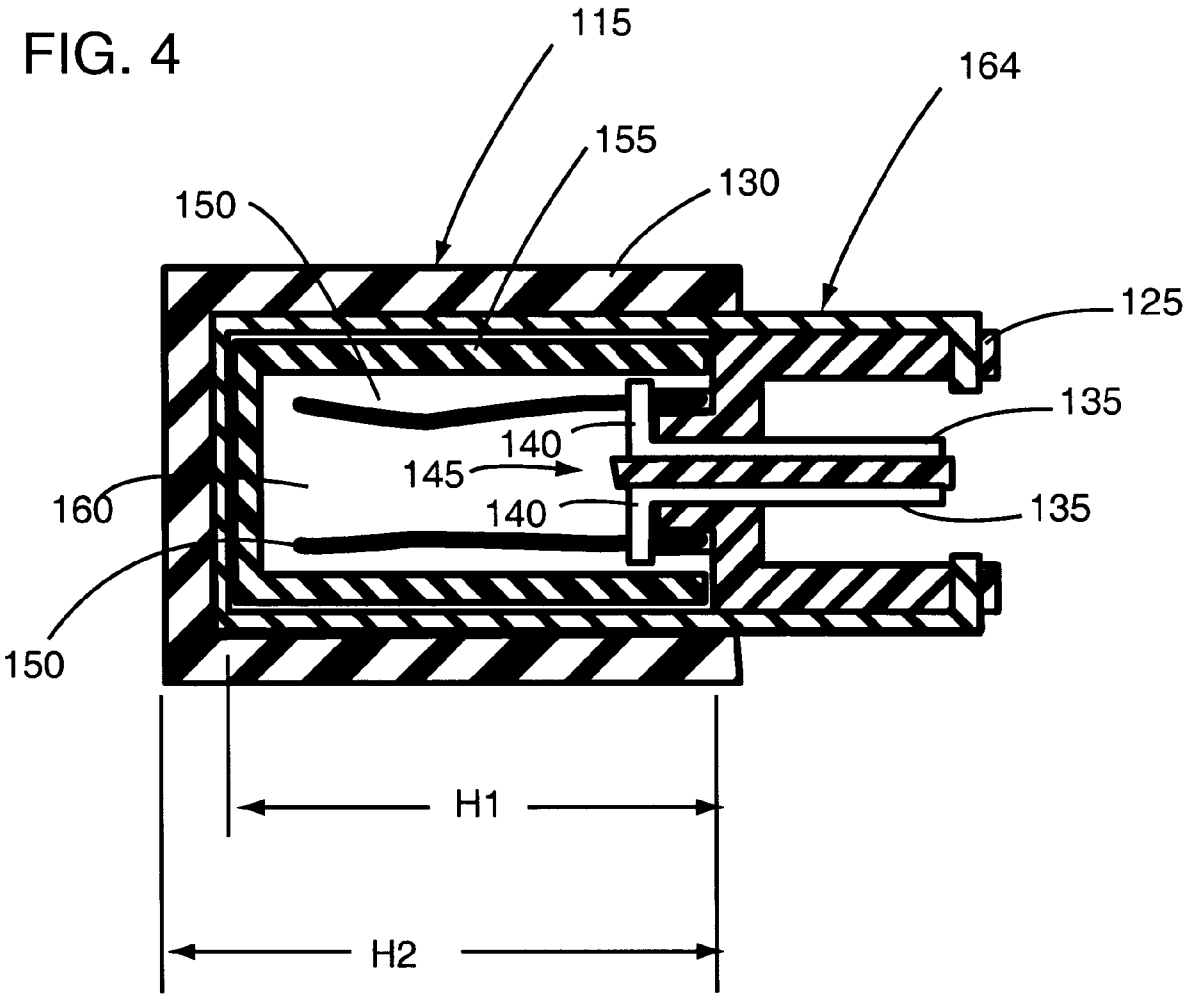
FIG. 4 is a cross sectional view taken along the line 4—4 in FIG. 3.

As depicted in FIG. 4, each one of the contact members 135 includes a wire attachment portion 140 adjacent to a wire attachment region 145 of the connector body 125. The wire attachment portion 140 of at least one of the contact members 135 has an insulated wire 150 attached thereto. An insulation displacement element is an example of the wire attachment portion 140.

The shielded connector assembly 115 includes an insulating insert 155. The wire attachment portion 140 of each one of the contact members 135 and the adjacent portion of each attached insulated wire 150 are positioned in a wire-receiving region 160 of the insulating insert 155. The wire-receiving region 160 defines an open end and a closed end of the insulating insert 155. A closed end as referred to herein may have a wire-receiving port extending therethrough. A cavity defined by the insulating insert is an example of the wire-receiving region 155.

The insulating insert 155 is made from a non-conductive material such as a polymeric material. Nylon, polyethylene, polypropylene, and polyester are examples of suitable polymeric materials. The insulating insert 155 may be formed using a technique such as injection molding, extrusion, or any other suitable manufacturing technique.

Still referring to FIG. 4, the shielded connector assembly 115 includes a shielding body 164 for limiting adverse affects of electromagnetic interference (EMI). The shielding body 164 covers at least a portion of the connector body 125 and at least a portion of the insulating insert 155. It is advantageous for the shielding body 164 to cover a significant portion of the connector body 125 and the insulating insert 155. In this manner, the potential for adverse affects associated with EMI is reduced.

Figure 5:
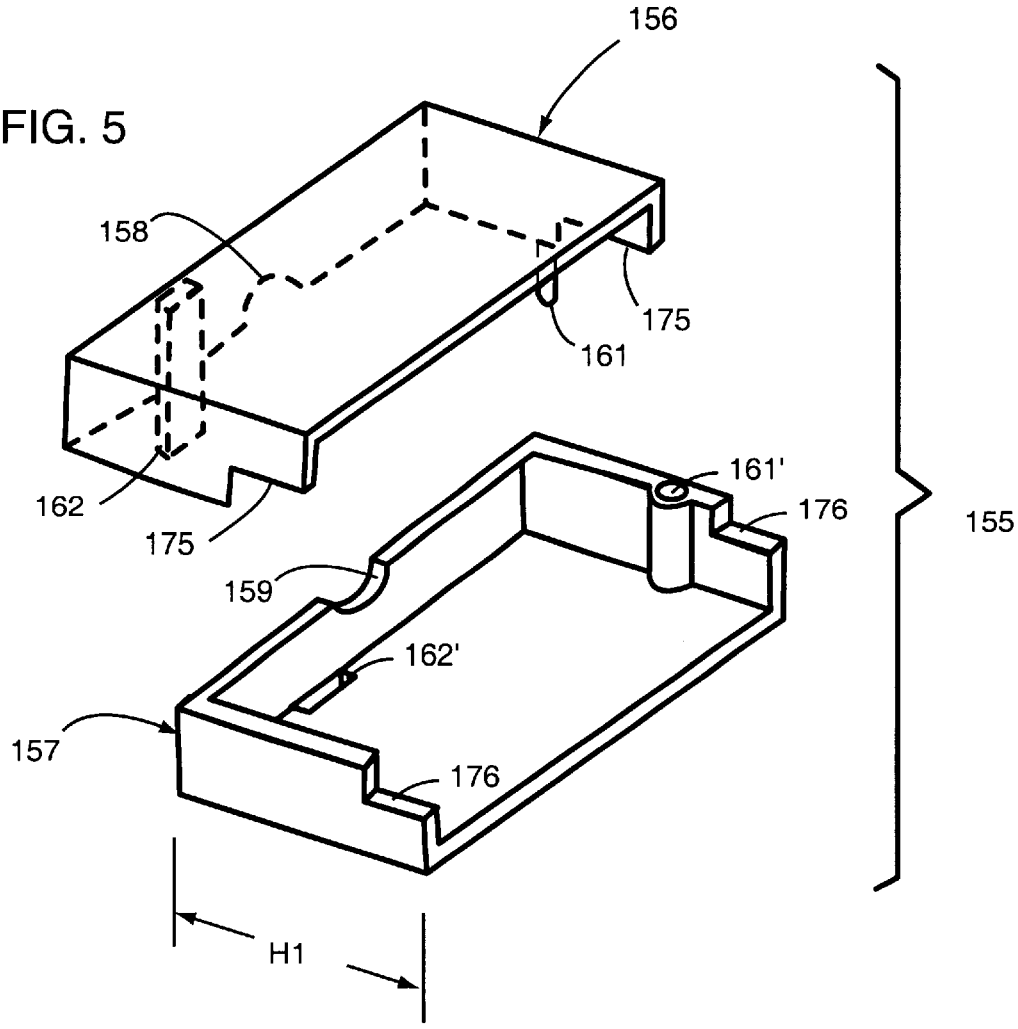
FIG. 5 is an exploded perspective view depicting a multi-piece insulating insert in accordance with embodiments of shielded connector assemblies disclosed herein.

A multi-piece embodiment of the insulating insert 155 is depicted in FIG. 5. The multi piece embodiment of the insulating insert 155 includes a first insulating member 156 and a second insulating member 157. The first and the second insulating members 156, 157 include respective wire-receiving port surfaces 158, 159. The wire-receiving ports 158, 159 of the first and the second insulating members 156, 157 jointly define a wire receiving port extending through the closed end of the insulating insert 155. As discussed above, the term closed end is defined herein to include the wire-receiving port extending therethrough in at least one embodiment of the insulating insert 155.

The first and the second insulating members 156, 157 are capable of being assembled over the wire attachment region 145 of the connector body 125. In this manner, the first and the second insulating members 156, 157 jointly define the wire-receiving region 160, FIG. 4, for receiving the wire attachment region 145 of the connector body 125 and the adjacent portion of the wire 150 attached to each one of the contact members 135. Furthermore, when the first and the second insulating members 156, 157 are assembled, one or more wires 150 of the cable 120, FIGS. 2 and 3, passes through the wire-receiving port jointly defined by the wire-receiving port surfaces 158, 159.

The first insulating member 156 includes a first alignment member 161 that is received by a first mating alignment feature 161' of the second insulating member 156. The first insulating member 156 includes a second alignment member 162 that is received by a second mating alignment feature 162' of the second insulating member 156. The alignment members 161, 162 and the respective mating alignment features 161', 162' aid in maintaining alignment of the first insulating member 156 with the second alignment member 157. It is contemplated herein that in at least one embodiment of the insulating insert 155, one ore more of the alignment members are omitted.

Figure 6:
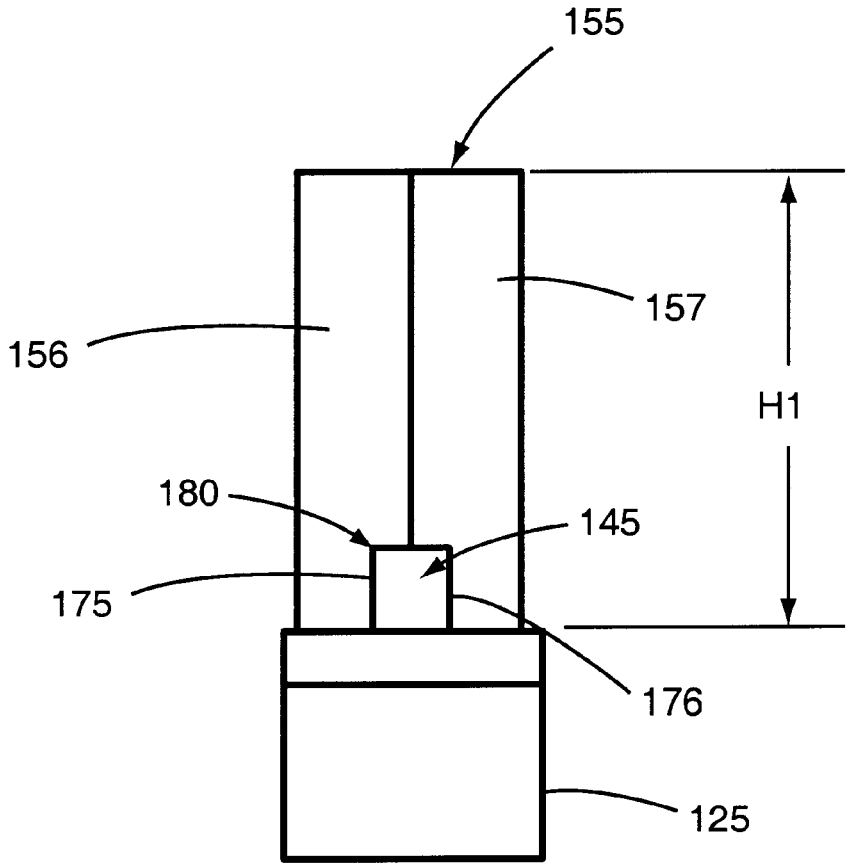
FIG. 6 is an end view depicting the insulating insert of FIG. 5 mounted on the connector body of FIGS. 3 and 4.

As depicted in FIGS. 5 and 6, the first and the second insulating members 156, 157 include respective shut-off surfaces 175, 176. The shut-off surfaces 175, 176 engage mating surfaces of the connector body 125, FIG. 6, thus forming a shut-off interface 180 between the insulating insert 155 and the connector body 125. In at least one embodiment, the shut-off surfaces 175, 176 engage mating surfaces at least partially defined by the wire attachment region 145 of the connector body 125.

The shut-off interface 180, FIG. 6, is advantageous as it limits the flow of material into the wire-receiving region 160, FIG. 4, of the insulating insert 155 during formation of the insulating cover 130. In some instances, such as when the insulating cover 130 is formed by an injection molding process, the material that forms the insulating cover 130 is under extremely high pressure. Accordingly, it is desirable to limit the flow of the material that forms the insulating cover 130 into the wire-receiving region 160 such that the potential for shorting of the contact members 135 and/or damaging the electrical connections at the wire attachment portion 140 is reduced.

Figure 7:
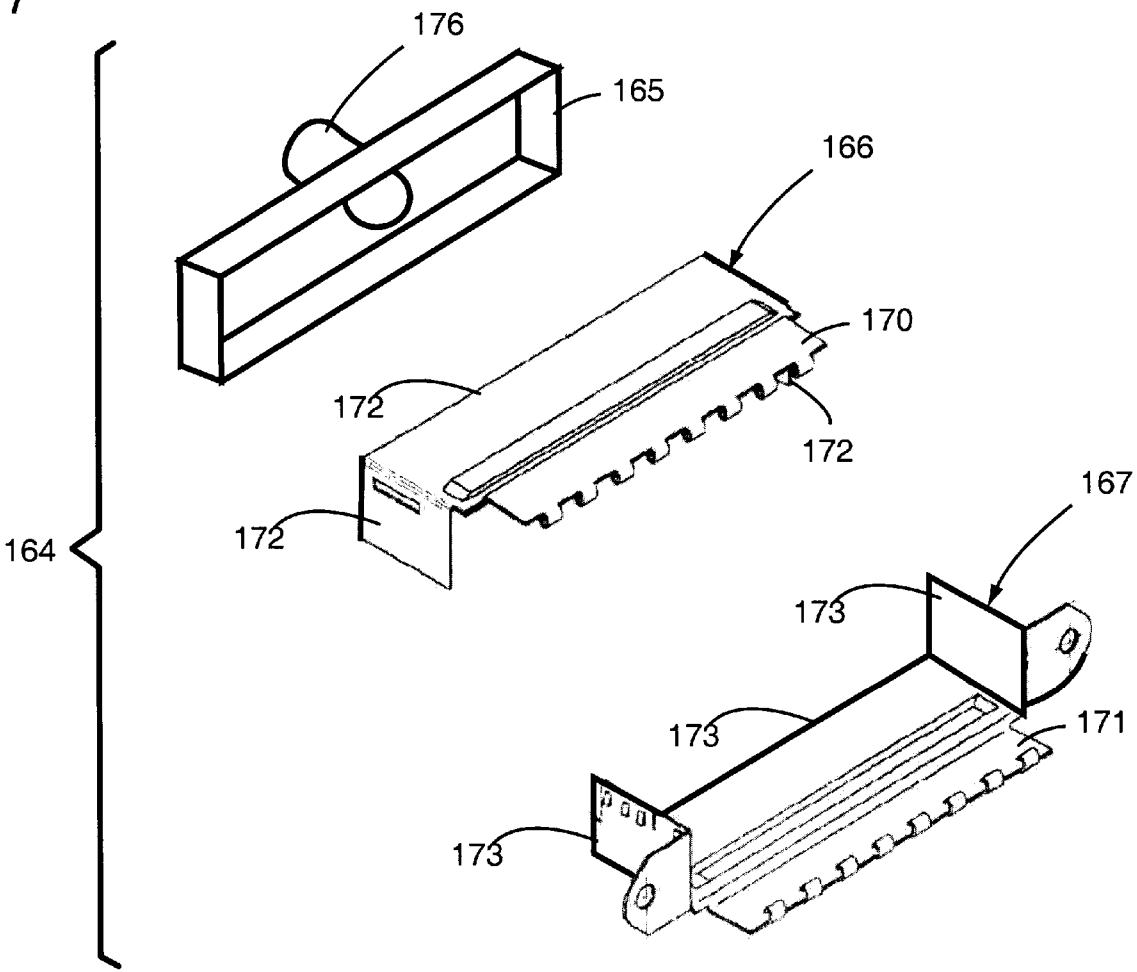
FIG. 7 is an exploded perspective view depicting a multi-piece shielding body in accordance with embodiments of shielded connector assemblies disclosed herein.
Figure 8:
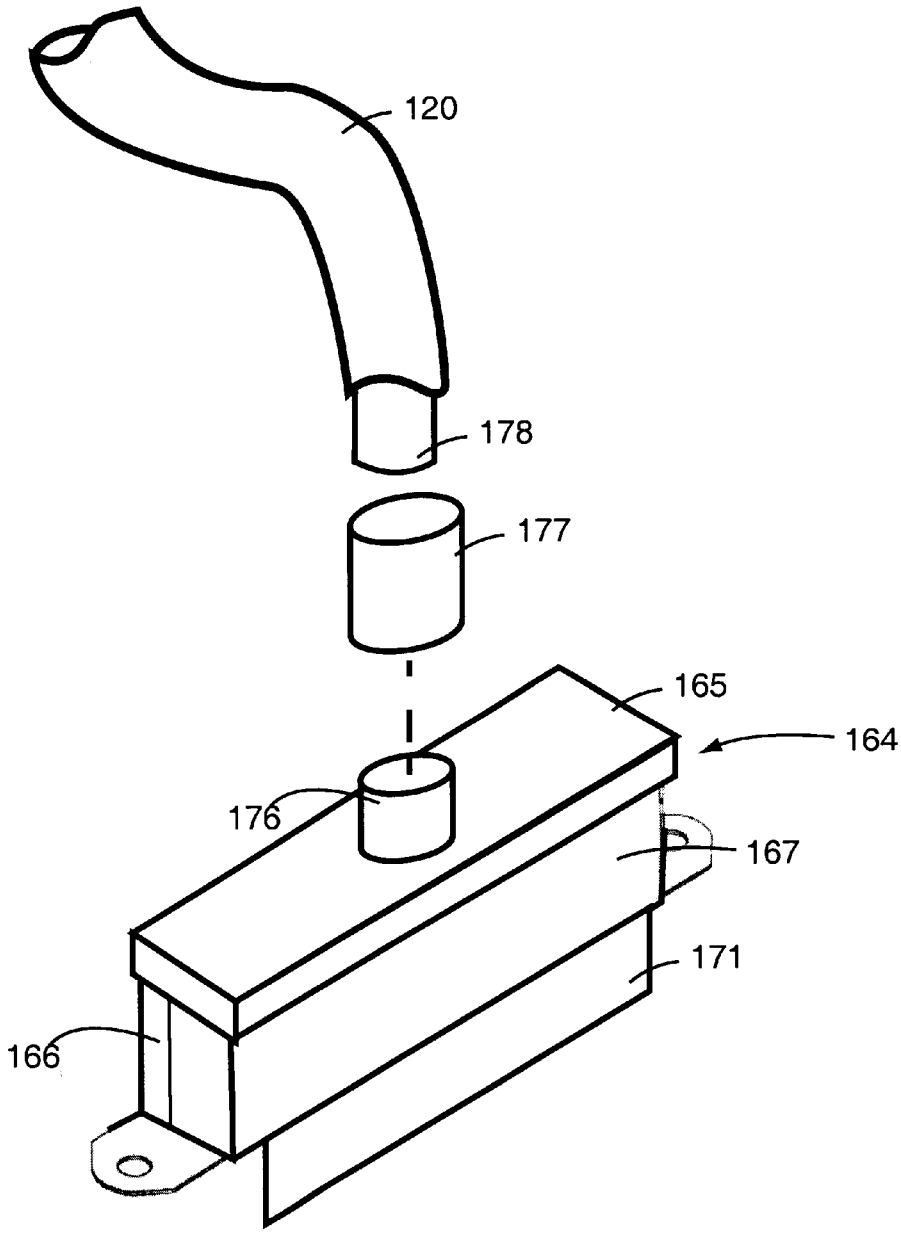
FIG. 8 is a partially exploded perspective view depicting the shielding body of FIG. 7, a shielded cable and a ferrule in accordance with embodiments of shielded connector assemblies disclosed herein.

A multi-piece embodiment of the shielding body 164 is depicted in FIGS. 7 and 8. The shielding body 164 includes a shielding end cap 165, a first shielding member 166 and a second shielding member 167. The first and the second shielding members 166, 167 include respective connector shielding portions 170, 171 and respective wire shielding portions 172, 173.

The first and the second shielding members 166, 167 are capable of being assembled over the connector body 125 and the insulating insert 155, thus forming a shielding sleeve. As depicted in FIG. 8, the shielding end cap 165 is mountable on the first and the second shielding members 166, 167 when the first and the second shielding members 166, 167 are assembled. In this manner, the wire shielding portions 172, 173 form an insert-receiving region for receiving the insulating insert 155 and the connector shielding portions 170, 171 engage at least a portion of the connector body 125. A cavity jointly defined by the wire shielding portions 172, 173 of the shielding body 164 and by the shielding end cap 165 is an example of the insert-receiving region of the shielding body 164. It is contemplated herein that the shielding body 164 may be of a one-piece construction.

The shielding end cap 165 includes a ferrule-engaging portion 176 for having a ferrule 177 engaged (e.g. crimped on) therewith when the shielded cable 120 is inserted through the ferrule engaging portion 176. In this manner, the shielding body 164 is capable of being electrically connected to a shielding layer 178 of the shielded cable 120, FIG. 8, for providing electrical continuity between the shielding body 164 and the shielding layer 178 of the shielded cable 120. Engaging the ferrule 177 on the ferrule-engaging portion 176 also serves to physically attach the shielding cable 120 to the shielded connector assembly 115.

A commercially available 50-position connector and commercially available shielding body, such as those available from Amp Incorporated, are examples of the connector body 125 and the shielding body 164, respectively. A CHAMP brand connector kit from Amp Incorporated includes a suitable commercially available connector and a suitable commercially available shielding body for fabrication a shielded connector assembly as disclosed herein. As discussed above, a suitable insulating insert may be fabricated using a process such as injection molding. A commercially available shielded cable, such as a 25-pair shielded cable from Prestolite Wire Corporation, is an example of the shielded cable 120.

The construction of the shielded connector assembly 115 disclosed herein is advantageous in applications where a shielded cable assembly including a compact (e.g. low-profile) shielded connector assembly is desirable or required. A shielded cable assembly having a back-plane connector for Digital Subscriber Line (DSL) equipment is one example of an application where a shielded cable assembly including a compact shielded connector assembly is useful.

A compact (e.g., low-profile) shielding body is used in constructing a compact shielded connector assembly. Such a compact shielding body has at least one reduced dimension relative to a conventional profile shielding body. Reducing the height and/or overall size of the shielding body enables a low profile shielded connector assembly to be provided. However, reducing the height and/or overall size of the shielding body also reduces the clearance between the shielding body, contact members of the shielded connector assembly, and wires connected to the contact members. In a conventional shielded connector assembly, the shielding body often deforms and/or moves during formation of the insulating cover, resulting in damage and/or shorting of the wires, contact members and electrical connections formed therebetween. The insulating insert disclosed herein advantageously reduces the potential for damage or shorting of the wires and contacts of the shielded connector assembly.

One conventional solution to limit deformation of the shielding body is to use a more robust shielding body in over-molded connector applications. The use of a more robust shielding body typically results in the shielding body being larger due to an increased wall thickness of the shielding body, due to structural features added to increase the strength of the shielding body or both. Increasing the size of the shielding body often precludes the corresponding connector from being used in applications in which a compact shielded connector assembly is required.

Conventional shielded connector assemblies generally provide more space within the confines of the shielding body for accommodating a service loop of the wire. The service loop is the individual wire length dedicated by a manufacturer for grasping and terminating each wire with the contacts of the connector assembly. Typically, the wires are terminated using an automated or at least semi-automated process.

Each wire has a designated minimum bend radius for a given wire size and/or type. Violating the designated minimum bend radius often results in damage to a conductor or the wire. A 180-degree connector requires each wire connected thereto to be bent twice. Conventional shielding bodies typically have a two-piece construction and tapered between the connector and the cable, thus providing a long area (i.e. relatively large volume) for the service loop. Embodiments of the shield body as disclosed herein have a connector height that is significantly reduced relative to conventional shielding bodies and conventional shielded connectors. The construction of the shielding end cap 165 contributes to the reduced height of the connector assembly and to a reduced space (i.e.volume) for the service loop. It has been found that the service loop can be reduce relative to conventional connector assemblies without adversely affecting connector performance.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. For example, functional blocks shown in the figures could be further combined or divided in any manner without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shielded cable assembly, comprising:

a connector body including a wire attachment region;

a contact member including a wire attachment portion, the contact member being mounted on the connector body with the wire attachment portion positioned adjacent to the wire attachment region of the connector body;

an insulating insert including a cavity having an open end, a closed end opposite the open end and an insulating insert wire-receiving port extending through the closed end, wherein the insulating insert is positioned adjacent to the connector body with at least a portion of the wire attachment portion of the contact member positioned within the cavity and wherein an insulating insert shut-off surface adjacent to the open end of the insulating insert is engaged with a mating shut-off surface of the connector body thereby defining a shut-off interface that limits the flow of an over-molded insulating cover material into the cavity during an over-molding operation;

a shielding body including an open end, a closed end opposite the open end and a shielding body wire-receiving port extending through the closed end, wherein an insert-receiving region is defined within the shielding body and wherein at least a portion of the insulating insert is positioned in the insert-receiving region and at least a portion of the shielding body is mounted directly on the connector body;

a cable including a wire extending into the cavity of the insulating insert through the insulating insert and shielding body wire-receiving ports and wherein the wire is electrically connected to the wire attachment portion of the contact member; and an over-molded insulating cover covering at least a portion of the shielding body.

2. The shielded cable assembly of claim 1 wherein the insulating insert includes shut-off surfaces that engage mating surfaces of the connector body.

3. The shielded cable assembly of claim 2 wherein the mating surfaces of the connector body are at least partially defined by the wire attachment region of the connector body.

4. The shielded cable assembly of claim 1 wherein the insulating insert is mounted on the wire attachment region of the connector body.

5. The shielded cable assembly of claim 1 wherein the insulating insert is a one-piece insulating insert.

6. The shielded cable assembly of claim 1 wherein the insulating insert is a multi-piece insulating insert.

7. The shielded cable assembly of claim 6 wherein the multi-piece insulating insert includes a first insulating member and a second insulating member.

8. The shielded cable assembly of claim 7 wherein the first insulating member includes an alignment member attached thereto and the second insulating member includes a mating alignment feature attached thereto, the alignment member capable of being engaged with the mating alignment feature when the first insulating member and the second insulating member are assembled over the wire attachment region of the connector body.

9. The shielded cable assembly of claim 1 wherein:

the shielding body is a multi-piece shielding body including a shielding end cap and a shielding sleeve having a first end and a second end;

the shielding sleeve mounted with the first end thereof positioned adjacent to the connector body; and the shielding end cap mounted on the second end of the shielding sleeve.

10. The shielded cable assembly of claim 9 wherein the shielding sleeve is a multi-part shielding sleeve including a first sleeve member and a second sleeve member mountable on the first sleeve member.

11. The shielded cable assembly of claim 9 wherein a closed end of the shielding end cap is at least partially engaged with the closed end of the insulating insert.

12. The shielded cable assembly of claim 1 wherein:

the shielding body includes a grounding flange attached adjacent to the shielding body wire-receiving port; and further comprising:

a grounding member electrically engaged with the grounding flange and a shielding layer of the cable.

* * * * *